United States Patent [19]

Newsome

[11] 4,082,202

[45] Apr. 4, 1978

[54] CIGARETTE DISPENSER AND LIGHTER

[76] Inventor: Mary H. Newsome, 156 Stratford Dr. N.W., Atlanta, Ga. 30311

[21] Appl. No.: 714,368

[22] Filed: Aug. 16, 1976

[51] Int. Cl.[2] ..... A24F 15/10

[52] U.S. Cl. ..... 221/147

[58] Field of Search ..... 221/143, 147, 148, 15, 221/16, 144–146

[56] References Cited

U.S. PATENT DOCUMENTS 2,220,445 11/1940 Greenbaum ..... 221/147

*Primary Examiner*—Stanley H. Tollberg

*Attorney, Agent, or Firm*—Robert B. Kennedy

[57] ABSTRACT

A cigarette dispenser and lighter having a housing, an inclined ramp mounted within the housing, a lift arm mounted adjacent the lower end of the ramp for pivotal movement between lowered and raised positions, and a gate coupled with the lift arm for passing cigarettes singly onto the lift arm from the ramp. A cigarette igniter is mounted within the housing which includes a resistance heating element mounted adjacent the lift arm coupled with a source of electrical current through a switch. An actuator is provided for actuating the lift arm, switch and gate.

6 Claims, 10 Drawing Figures

CIGARETTE DISPENSER AND LIGHTER

BACKGROUND OF THE INVENTION

This invention relates generally to cigarette dispensers, and particularly to cigarette dispensers of the type which include means for lighting cigarettes as they are dispensed.

Heretofore, cigarette dispensers have been provided with flame generating means for igniting the cigarettes as they are dispensed as disclosed in U.S. Pat. Nos. 1,282,882 and 2,281,060. More recently, as disclosed in U.S. Pat. No. 3,307,741, cigarette dispensers have been provided with electrical resistance heating elements for igniting the cigarettes as they are dispensed. The use of electrical heating means has simplified the mechanisms for actuating the igniters and has lessened the danger of the dispenser itself being damaged by an ignition flame.

Though cigarette dispensers with electrical heating element lighters haver heretofore operated with some success, several problems in their construction have persisted. For example, where cigarettes are routed aside the heating element their degree of proximity therewith varies. This variation often leads to ignition failure or to such minimal ignition as to self-extinguish before a smoker has an opportunity to draw air in through the cigarette and thereby enhance combustion. The mechanisms employed in timing the passage of the cigarette over the heating element have themselves been powered by the same source of electric current used in powering the heating element. This places excessive load upon the source of current, particularly where that source is a battery, thereby shortening the life of the power source or necessitating frequent recharging.

Where the cigarettes have exited the prior art dispensers to accessible trays, either end may be gripped. This has led to instances of an inattentive user mistaking the ignited end for the unignited end thereby self-inflicting personal injury. Where cigarettes have been stacked one upon the other within the dispenser, there has been some tendency for multiple cigarettes to become ignited simultaneously or to jam gate mechanisms provided for inhibiting such multiplicities of ignitions.

Accordingly, it is a general object of the present invention to provide an improved cigarette dispenser and lighter.

More specifically it is an object of the invention to provide a cigarette dispenser and lighter with improved cigarette ignition means.

Another object of the invention is to provide a cigarette dispenser and lighter with relatively simple mechanical means for successively bringing individual cigarettes into timed engagement with an electrical heating element.

Another object of the invention is to provide a cigarette dispenser and lighter of the type described with means for rendering only unlit ends of cigarettes accessible to users.

Yet another object of the invention is to provide a cigarette dispenser and lighter of the type described with relatively simple and reliable gate means for inhibiting cigarettes stacked in multiple layers from passing in groups into contact with the igniter.

SUMMARY OF THE INVENTION

In one form of the invention a cigarette dispenser and lighter is provided comprising a housing, an inclined ramp mounted within the housing upon which a plurality of cigarettes may be placed, and a lift arm mounted adjacent the lower end of the ramp for pivotal movement between lowered and raised positions. Gate means are provided coupled with the lift arm for passing cigarettes singlely onto the lift arm from the ramp. Cigarette igniting means are mounted within the housing which includes a resistance heating element mounted adjacent the lift arm coupled with a source of electrical current through a switch. Actuator means are also provided for actuating the lift arm, the switch and the gate means.

In another form of the invention a cigarette dispenser and lighter is provided comprising a housing sized to hold a plurality of cigarettes, and a lift arm mounted to the housing for pivotal movement about a pivot axis between lowered and raised positions. A resistance heating element is mounted to the lift arm adjacent the pivot axis coupled with a source of electric current through a switch. A spring is provided biasing the lift arm to the raised position. Actuator means are also provided for lowering and raising the lift arm and for cycling the switch in energizing and deenergizing the heating element.

DETAILED DESCRIPTION OF THE PREFERRED EMBODIMENT

Figure 1:
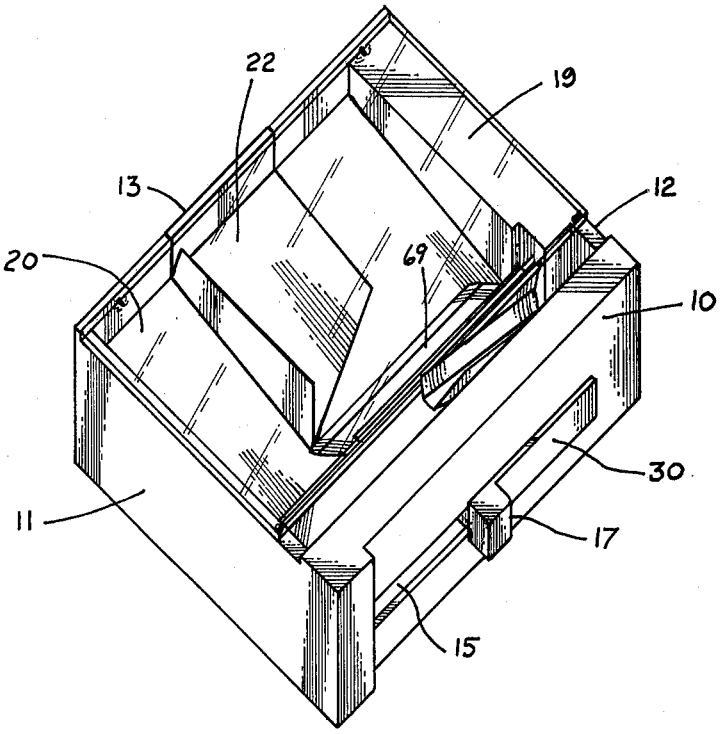
FIG. 1 is a perspective view of a cigarette dispenser and lighter embodying principles of the invention in one preferred form.
Figure 2:
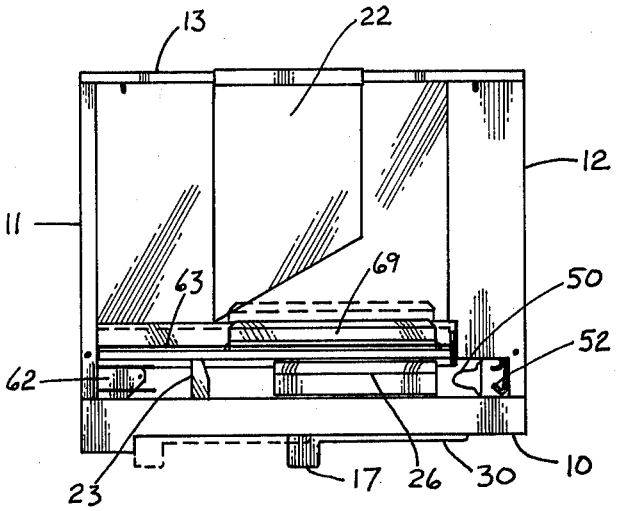
FIG. 2 is a plan view of the cigarette dispenser and lighter shown in FIG. 1.

Referring now in more detail to the drawing, there is shown in FIGS. 1 and 2 a cigarette dispenser and lighter comprising a housing having a front wall 10, two side walls 11 and 12, and a rear wall 13. The front wall is provided with a slot 15 in which is slidably mounted an actuator having a handle 17 for movement between the normal actuator position shown in FIG. 1 and the momentarily actuated position shown in broken lines.

The housing is provided with a transparent, removable cover or lid 19 having a series of pegs depending therefrom located as to be slidably placed within receiving pin holes within the walls upon which it rests. An incline ramp 20 is rigidly mounted within the housing beneath the cover. An adjustable guide tab 22 is mounted within the housing in laterally sliding engagement atop the ramp. A second adjustable guide tab 23 is also provided adjacent the actuator.

Figure 4:
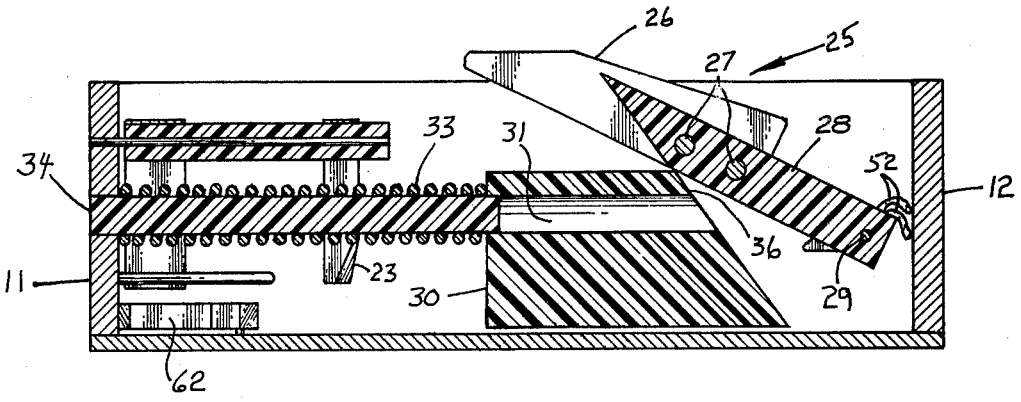
FIG. 4 is an end elevational view taken in cross-section along plane 4—4 of the cigarette dispenser and lighter shown in FIG. 3.
Figure 5:
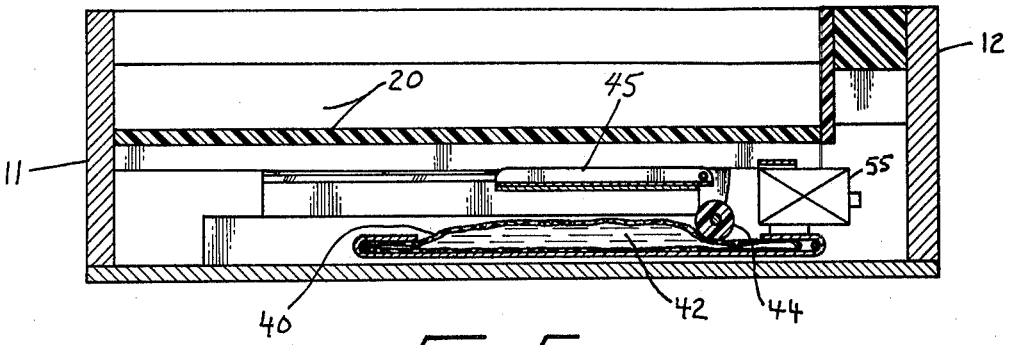
FIG. 5 is another end elevational view taken in cross-section along plane 5—5 of the cigarette dispenser and lighter shown in FIG. 3.
Figure 6:
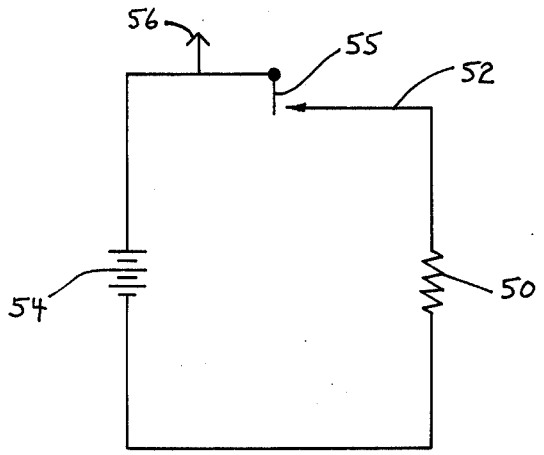
FIG. 6 is a circuit diagram of the cigarette lighter component of the cigarette dispenser and lighter shown in FIGS. 1–3.

With reference next to the other figures the dispenser and lighter is further seen to include a lift arm 25 having a chute 26 rigidly secured by fasteners to an arm 28 mounted for pivotable movement about pivot pin 29. Lift arm actuating means are also provided comprising an actuator block 30 having a guide channel 31 therein from which block projects handle 17. Actuator block 30 is biased to the right as viewed in FIG. 4, by means of a compression spring 33 mounted about a guide rod 34 having one end positioned within actuator block channel 31, and another end fixedly received within side wall 11. When actuator handle 17 is manually released and in its normal, at rest position the actuator is positioned with actuator block camming surface 36 forcing the pivotable lift arm to the raised position shown in FIG. 4. Upon manual movement of the handle to the left, as viewed in FIGS. 1, 2 and 4, against the force of compression spring 33, the lift arm is permitted to drop to a generally horizontal position adjacent the lower end of ramp 20 to receive a single cigarette therefrom. Upon manually releasing the handle from its position to the left shown in broken lines in FIG. 2, compression spring 33 urges the actuator block back to the right thereby raising the lift arm from its lowered position to its raised position.

In so returning the lift arm to its raised position the movement of the actuator block is slowed by hydraulic brake means. The hydraulic brake means includes a hydraulic brake pad 40 in which a low viscuous liquid 42 is contained. It further includes brake roller 44 pivotably mounted to an actuator plate 45 that is rigidly secured to the actuator block.

Mounted to and carried by the lift arm adjacent pivot pin 29 is a resistance heating element 50. The heating element is coupled by means of flexible, insulated conductors 52 to three serially connected batteries 54 through an electric switch 55. Jack means 56 may also be provided for recharging the batteries. Switch 55 has a pivotable contact arm 57 that is actuatable by the actuator plate 45 itself. The body of the switch serves as a limit for movement of the entire actuator assembly to the right.

Figure 3:
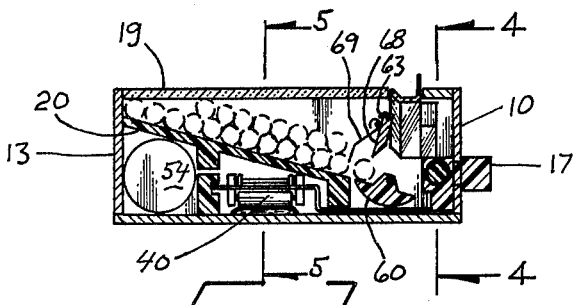
FIG. 3 is a side view, in cross-section, of the cigarette dispenser and lighter shown in FIGS. 1 and 2.
Figure 7:
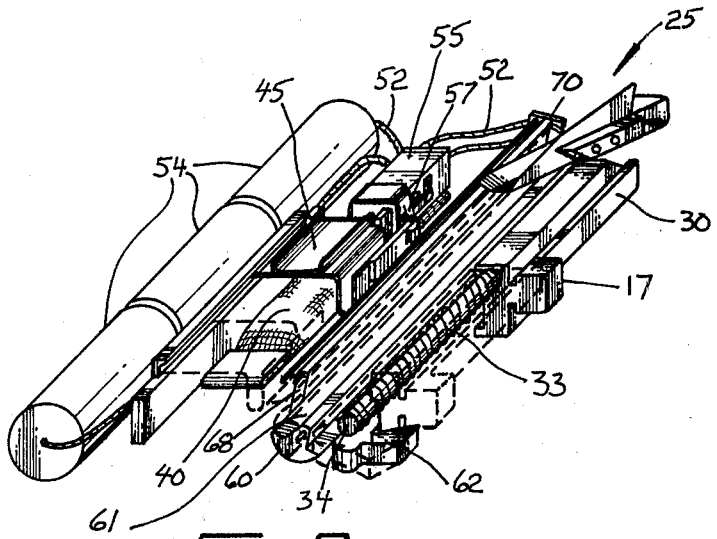
FIG. 7 is a perspective view of the cigarette dispenser and lighter shown in FIGS. 1–3.

The cigarette dispenser and lighter is further seen to include gate means for permitting entry of cigarettes one at a time from the dispenser ramp onto the lift arm chute. This gate means includes a pivotable swing floor 60 having a trough 61 contoured and sized to receive individual cigarettes and then pass them singlely onto the lift arm chute upon pivotable movement of the swing floor. This movement is effected upon engagement of actuator block 30 with a spring biased cam 62 mounted for movement about a vertical axis. As seen in FIG. 7 cam 62 is movable from its normal position shown in solid lines to its temporarily actuated position shown in broken lines in causing the swing floor 60 to rotate clockwise and thereby pass a cigarette held within trough 61 onto the lift arm chute. Upon release of the actuator handle 17 the actuator block 30 then moves out of engagement with the cam which itself returns under its spring bias to its position shown in solid lines. Thereupon, the swing floor returns also to its normal position shown in FIG. 3 under the bias of another wire spring 63. Accompanying the just described movement is that of pivotable stop 68 and pivotable flap 69 secured thereupon. The pivotable stop is coupled with the swing floor by link 70 which is mounted to one end of the swing floor by an unshown pin. So assembled, clockwise movement of the swing floor causes the pivotable stop 68 also to pivot in a clockwise direction from its position shown in solid lines in FIGS. 8–10 to that shown in broken lines. Flap 69, secured to the pivotable stop, accompanies this movement.

Figure 8:
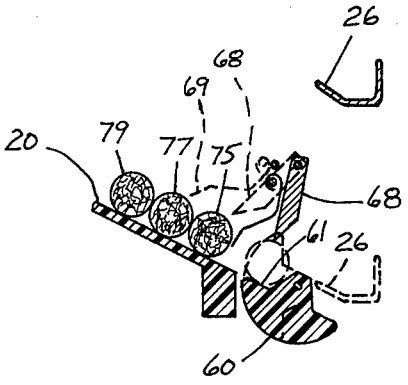
FIGS. 8–10 are three sequential, diagramatic illustrations of the operation of the gate means component of the cigarette dispenser and lighter shown in FIGS. 1–3.
Figure 9:
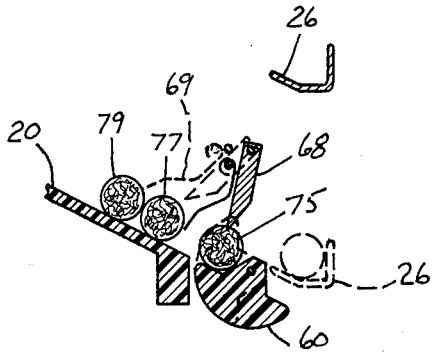
Figure 10:
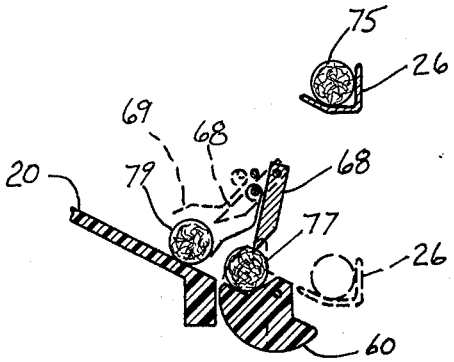

With specific references next to FIGS. 8–10, a gating sequence may be clearly visualized. In FIG. 8 three cigarettes 75, 77 and 79 are seen to be successively positioned upon ramp 20. Entry of a cigarette onto the swing floor is here inhibited by the position of the pivotable flap 69. Upon movement of the actuator mechanism the pivotable stop is moved clockwise to the position shown in broken lines as is the pivotable flap. In the raised position the swing floor itself is pivoted clockwise to its position shown in broken lines. So positioned, cigarette 75 is gravitated into contact with the arcuate bottom of the swing floor beneath the pivotable flap. With the flap so raised cigarettes stacked atop cigarettes 75, 77 and 79 in layers are prevented from moving into the gate.

Once the actuator is now released the swing floor, pivotable stop and pivotable flap rotate counterclockwise back to the position shown in the solid lines. At this point cigarette 75 is positioned upon the swing floor as shown in FIG. 9 while cigarette 77 is resting against the pivotable flap. Upon the next actuation the swing floor again pivots clockwise thereby dumping cigarette 75 on the chute 26 and cigarette 77 is moved under the pivotable flap into engagement with the arcuate bottom of the swing floor. Once the actuator has fully cycled the chute 26 rises and the pivotable stop and flap rotate counterclockwise back to the position shown in solid lines in FIG. 10. Now it is seen in this figure that cigarette 75 rests upon the raised chute, cigarette 77 rests upon the swing floor, and cigarette 79 rests upon the pivotable flap.

Upon manual movement of the actuator handle to the left as viewed in FIG. 1 causes the actuator plate 45 to move out of engagement with the switch contact arm 57 thereby establishing a circuit connection of the resistance heating element with the batteries causing the element to ignite. This movement of the handle to the left also positions the next cigarette for passage through the gate and lowers the chute to receive it when dumped from the swing floor. Upon release of the handle the actuator slowly moves under the forces of the compression spring and hydraulic brake back to the right. This action causes the chute slowly to rise and the gate to position one cigarette upon the swing floor for the next cycle of operation. At the conclusion of the return movement of the actuator the electric switch contact arm is once again engaged and moved thereby disconnecting the resistance heating element from its power source. At this point the cigarette, which has been resting upon the chute gravitated against the resistance heating element, will have been ignited and in position for manual access by a smoker.

It should be understood that the just described embodiment merely illustrates principles of the invention in one preferred form. Many modifications, additions and deletions may, of course, be made thereto without departure from the spirit and scope of the invention as set forth in the following claims.

I claim:

1. A cigarette dispenser and lighter comprising a housing, an inclined ramp mounted within said housing upon which a plurality of cigarettes may be placed; a lift arm mounted adjacent the lower end of said ramp for pivotal movement between lowered and raised positions; gate means coupled with said lift arm for passing cigarettes singlely onto said lift arm from said ramp; cigarette igniting means mounted within said housing and including a resistance heating element mounted adjacent said lift arm coupled with a source of electrical current through a switch; actuator means for activating said lift arm, said switch and said gate means; and hydraulic brake means mounted adjacent said inclined ramp for braking movement of said actuator means relative said inclined ramp.

2. A cigarette dispenser and lighter comprising a housing, an inclined ramp mounted within said housing upon which a plurality of cigarettes may be placed; a lift arm mounted adjacent the lower end of said ramp for pivotal movement between lowered and raised positions; gate means coupled with said lift arm for passing cigarettes singlely onto said lift arm from said ramp and including a swing floor mounted for pivotal movement adjacent the lower end of said inclined ramp, and a flap mounted above said swing floor for pivotal movement with pivotal movement of said swing floor; cigarette igniting means mounted within said housing and including a resistance heating element mounted adjacent said lift arm coupled with a source of electrical current through a switch; and actuator means for activating said lift arm, said switch and said gate means.

3. A cigarette dispenser and lighter comprising a housing, an inclined ramp mounted within said housing upon which a plurality of cigarettes may be placed; a lift arm mounted adjacent the lower end of said ramp for pivotal movement between lowered and raised positions; spring means for biasing said lift arm to said raised position; gate means coupled with said lift arm for passing cigarettes singlely onto said lift arm from said ramp; cigarette igniting means mounted within said housing and including a resistance heating element mounted adjacent said lift arm coupled with a source of electrical current through a switch; and actuator means for activating said lift arm, said switch and said gate means.

4. A cigarette dispenser and lighter comprising a housing sized to hold a plurality of cigarettes; a lift arm mounted to said housing for pivotal movement about a pivot axis between lowered and raised positions; a resistance heating element mounted to said lift arm adjacent said pivot axis coupled with a source of electric current through a switch; a spring biasing said lift arm to said raised position; and actuator means for lowering and raising said lift arm and for cycling said switch in energizing and deenergizing said heating element.

5. A cigarette dispenser and lighter in accordance with claim 4 comprising hydraulic brake means for braking rising movement of said lift arm from said lowered to said raised positions.

6. A cigarette dispenser and lighter in accordance with claim 5 wherein said switch includes a movable switch contact arm, and wherein said actuator means is mounted for movement in sliding engagement with said hydraulic brake means into and out of contact with said switch contact arm.

* * * * *